US008079699B2

(12) United States Patent
Okada

(10) Patent No.: US 8,079,699 B2
(45) Date of Patent: Dec. 20, 2011

(54) INKJET RECORDING APPARATUS

(75) Inventor: Goro Okada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 552 days.

(21) Appl. No.: 12/196,217

(22) Filed: Aug. 21, 2008

(65) Prior Publication Data

US 2009/0051747 A1 Feb. 26, 2009

(30) Foreign Application Priority Data

Aug. 23, 2007 (JP) ..... 2007-216642

(51) Int. Cl.
*B41J 2/01* (2006.01)

(52) U.S. Cl. ..... 347/104; 347/103; 347/101

(58) Field of Classification Search ..... 347/103, 347/101, 88, 99, 102, 104
See application file for complete search history.

(56) References Cited

U.S. PATENT DOCUMENTS 6,529,700 B2 * 3/2003 Nukada et al. ..... 399/249
2007/0035569 A1 * 2/2007 Koto et al. ..... 347/14

FOREIGN PATENT DOCUMENTS

JP 10175341 A * 6/1998
JP H10-175341 A 6/1998

* cited by examiner

*Primary Examiner* — Manish S Shah
(74) *Attorney, Agent, or Firm* — Baker Botts L.L.P.

(57) ABSTRACT

An image recording apparatus of the present invention includes a conveyance mechanism having a circumferential wall. On the circumferential wall are formed suction holes which communicate an internal space inside the circumferential wall with the outside of the circumferential wall. A recording medium is placed on the outer circumferential surface of the circumferential wall, and is conveyed on the outer circumferential surface in a direction of the rotation of the circumferential wall. A suction unit sucks the air in the internal space to create an air flow from the outside of the circumferential wall to the internal space via the suction holes. A recording medium ejection path branches off from the outer circumferential surface at a separating position which is at the most downstream position of a record head or a position further from the supply position S1 than the most downstream position from the supply position. A blocker positioned in the internal space successively faces an inner opening of at least one of the suction holes having reached the separating position with the movement of the circumferential wall, so as to block the inner opening of the at least one of the suction holes.

9 Claims, 6 Drawing Sheets

INKJET RECORDING APPARATUS

CROSS REFERENCE TO RELATED APPLICATION

The present application claims priority from Japanese Patent Application No. 2007-216642, which was filed on Aug. 23, 2007, the disclosure of which is herein incorporated by reference in its entirety.

BACKGROUND OF THE INVENTION

1. Field of the Invention

The present invention relates to an image recording apparatus which records an image on a recording medium.

2. Description of the Related Art

Japanese Unexamined Patent Publication No. 175341/1998 (Tokukaihei 10-175341) discloses a printer including a conveyance mechanism having a drum. Rotation of the drum carrying a sheet on its outer circumferential surface conveys the sheet in the circumferential direction along the outer circumferential surface. In such a conveyance mechanism, the drum is provided with suction holes which communicate the outside of the drum with the internal space of the same. This drum is rotatably supported by a pipe whose internal space is communicated with the internal space of the drum. Through an opening at one end of this pipe, the air in the internal space of the drum is sucked by a suction fan. Closing the other end of the pipe by a plug creates a pressure difference between the suction holes and the outside of the drum over the sheet, generating a suction force to adsorb the sheet on the outer circumferential surface of the drum. On the other hand, when the other end of the pipe is not closed by the plug, the suction force drops so that the sheet becomes easily separable from the outer circumferential surface of the drum.

SUMMARY OF THE INVENTION

In the above mentioned technique, the other end of the pipe is closed by the plug to adsorb the sheet on to the outer circumferential surface of the drum, until the sheet reaches a separation position. The other end of the pipe is then opened by moving the plug when the sheet reaches the separation position, thereby making the sheet easily separable from the outer circumferential surface of the drum. In the structure, however, the suction holes are apart from the plug by a relatively long distance. Therefore, after the plug is moved to open the other end of the pipe, a certain time is required before the suction force drops to a level where the sheet becomes easily separable. This causes difficulty in promptly separating the sheet from the outer circumferential surface, consequently lowering the printing throughput. Further, the plug needs to be moved, and this requires a complicated structure.

In view of the above, the present invention is made and it is an object of the present invention to provide a simply structured image recording apparatus which allows easy and prompt separation of an adsorbed recording medium.

An image recording apparatus of the present invention includes: a conveyance mechanism, a suction unit, a supply mechanism, a record head, an ejection path, and a blocker. The conveyance mechanism has a circumferential wall having thereon a plurality of suction holes for communicating an internal space inside the circumferential wall with the outside of the circumferential wall, the conveyance mechanism being structured to convey, with rotation of the circumferential wall, a recording medium placed on an outer circumferential surface of the circumferential wall. The suction unit sucks the air in the internal space to create an air flow from the outside of the circumferential wall to the internal space via the suction holes. The supply mechanism which supplies, at a supply position, a recording medium to the outer circumferential surface. The record head disposed to face the outer circumferential surface, which records an image on the recording medium conveyed on the outer circumferential surface by the conveyance mechanism. The ejection path branched off from the outer circumferential surface at a separating position which is a position at a most downstream position of the record head or a position further from the supply position than the most downstream position from the supply position, the ejection path being structured to pass therethrough an image-recorded recording medium to be ejected on the outer circumferential surface. The blocker disposed in the internal space, which successively faces an inner opening of at least one of the suction holes having reached the separating position with the rotation of the circumferential wall so as to block the inner opening of the at least one of the suction holes.

With the present invention, the blocker disposed in the internal space of the circumferential wall successively faces an inner opening of at least one of the suction holes having reached the separating position, thereby blocking the inner opening of the suction hole. Directly blocking the inner opening of a suction hole by the blocker reduces the pressure difference between the suction hole and the outside of the drum over the recording medium, thus promptly reducing the suction force in the suction hole immediately after the blocker blocks the inner opening. Thus, the recording medium becomes easily separable from the outer circumferential surface of the circumferential wall, successively from its leading end to the trailing end, immediately after the leading end of the recording medium reaches the separating position. Further, the present invention is further advantageous in that the blocker only needs to be inside the circumferential wall, and there is no need of moving the blocker. Thus, the structure of the image recording apparatus is made simple.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Embodiment 1

Figure 1:
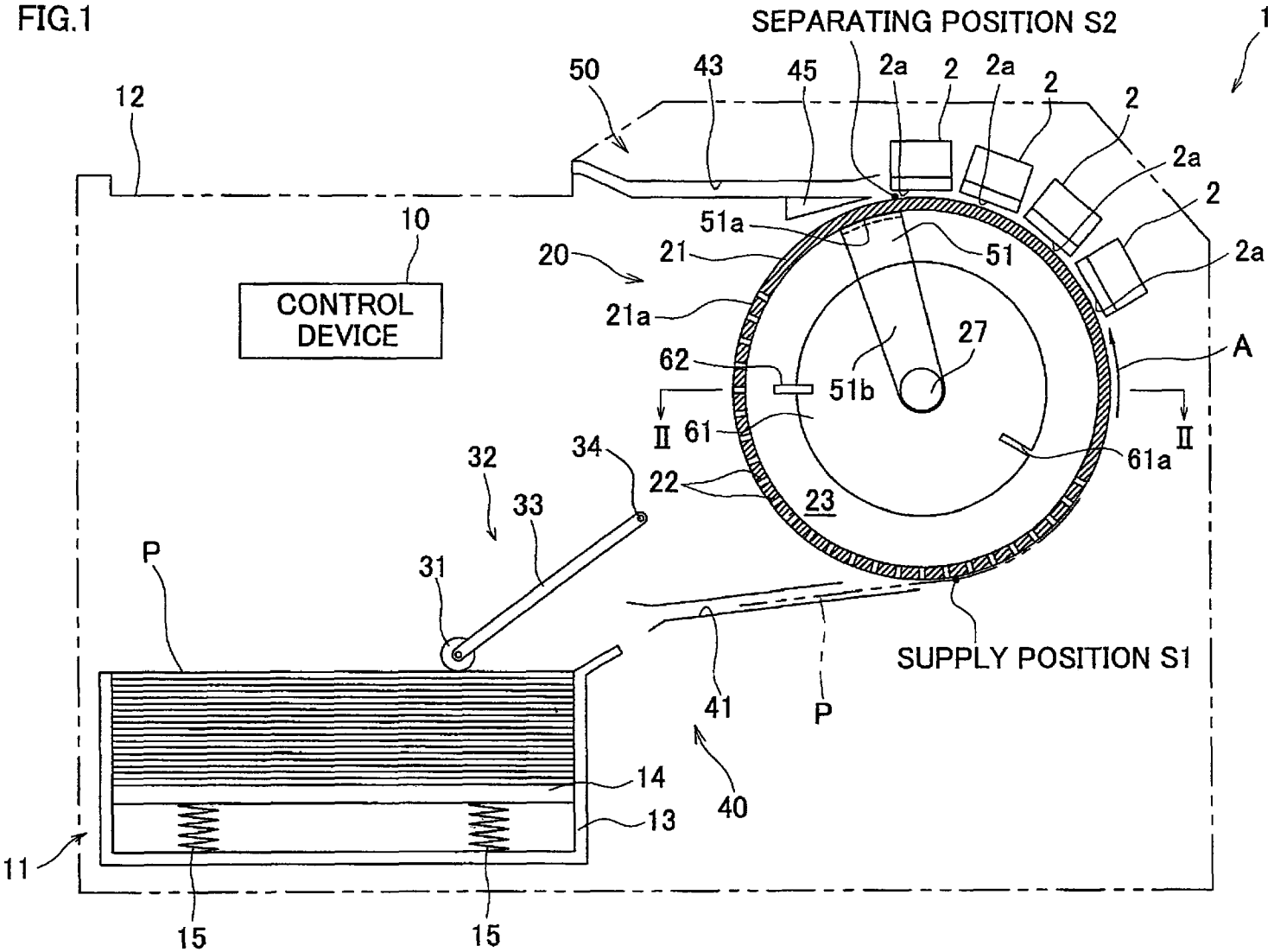
FIG. 1 is a side view illustrating an inkjet printer of Embodiment 1, according to the present invention.

The following describes, with reference to FIG. 1, an inkjet printer of Embodiment 1, according to the present invention. An inkjet printer 1 serving as an image recording apparatus is a color inkjet printer, and includes a sheet conveyance mechanism 20, a supply mechanism 40, an ejection mechanism 50, and a control device 10. The sheet conveyance mechanism 20 has four inkjet heads 2 each serving as a record head, and a drum 21 having a cylindrical outer circumferential surface 21*a*. The supply mechanism supplies a sheet to the outer circumferential surface 21*a*, at a supply position S1 which is a fixed position nearby the lower end of the drum 21 in the inkjet printer 1. The ejection mechanism 50 separates, from the outer circumferential surface 21, the sheet having reached at the separating position S2 nearby the upper end of the drum 21, and ejects the sheet via an ejection path 43. The control device 10 serves as a control unit for controlling operations of these members. The separating position S2 is a fixed position in the inkjet printer 1, which position is at the most downstream position of the four inkjet heads 2 or further from the supply position S1 than the most downstream position of the four inkjet heads 2 from the supply position S1 in a conveyance direction indicated by the arrow A; that is, in the rotation direction of the drum 21. In the present embodiment, the separating position S2 is at the most downstream position of an inkjet head 2 which is most downstream from the other inkjet heads 2. In the lower part of the inkjet printer 1 is provided a sheet-feeding tray 11. On the top surface of the casing is provided a sheet receiving tray 12. Further, in the inkjet printer 1, a sheet conveyance path is formed. This sheet conveyance path extends from the sheet-feeding tray 11 to the lower end of the drum 21, and extends from the lower end of the drum 21 to the upper end of the drum 21 along the outer circumferential surface 21*a* of the drum 21. At the separating position D, the sheet conveyance path branches from the outer circumferential surface 21*a* and extends to the sheet receiving tray 12 via the ejection path 43.

Each of the four inkjet heads 2 has ink passages having nozzles for ejecting ink droplets, and is formed in a parallelepiped shape elongated in the axial direction of the drum 21. From each of these inkjet heads 2 is ejected ink of one of the following four colors: magenta, yellow, cyan, and black. These four inkjet heads 2 are aligned in the circumferential direction of the drum 21 along the outer circumferential surface thereof. In short, the inkjet printer 1 is a line printer.

The lower surface of each of the inkjet heads 2 serves as an ejection surface 2*a* having thereon nozzle openings. This ejection surface 2*a* of the inkjet head 2 faces the outer circumferential surface 21*a*. The normal to the center of each ejection surface 2*a* is perpendicular to the outer circumferential surface 21*a*.

The sheet-feeding tray 11 has a tray main body 13 opened in the upper direction. In the tray main body 13 is stored a stack of sheets P. Inside the tray main body 13 are arranged a plate 14 which supports the sheets P from the bottom, and two springs 15 which urges the plate 14 upward. The plate 14 is formed in a plane shape which is substantially the same as the tray main body 13, and is disposed in such a manner that the plate 14 is able to move upward or downward within the tray main body 13.

Further, the inkjet printer 1 includes a pickup roller 31 and a pickup roller moving mechanism 32 which rotates the pickup roller 31. The pickup roller 31, while being rotated, contacts a sheet P at the top of the stack of sheets P in the tray main body 13 so as to feed out the sheet P to the drum 21.

The pickup roller moving mechanism 32 includes a turning arm 33, a shaft 34, and a not-illustrated drive motor. A lower end of the turning arm 33 rotatably supports the pickup roller 31, and an upper end of the same is fixed to the shaft 34. The drive motor rotates the shaft 34 to rotate the turning arm 33 about the shaft 34. With this pickup roller moving mechanism 32, the turning arm 33 is moved so that the pickup roller 31 is positioned in one of the following two positions: a contact position where the pickup roller 31 contacts the uppermost sheet P in the tray main body 13; and a separation position where the pickup roller 31 is apart from the uppermost sheet P in the tray main body 13. While the pickup roller 31 is in the separation position, the sheet-feeding tray 11 is easily attached or detached. Note that aforementioned springs 15 are structured in such a manner that a friction within a predetermined range is generated between the pickup roller 31 and the uppermost sheet P, irrespective of the number of sheets P stored in the tray main body 13. This prevents a problem in feeding out a sheet P by the pickup roller 31.

Further, as a part of a sheet conveyance path, the inkjet printer 1 includes an introduction path 41 through which a sheet P sent out from the sheet-feeding tray 11 by the pickup roller 31 is lead to the outer circumferential surface 21*a* of the drum 21, which surface adsorbs and retains thereon the sheet P. The introduction path 41 is a substantially straight path which extends from the sheet-feeding tray 11 to the lower end of the drum 21. The pickup roller moving mechanism 32 and the introduction path 41 form the supply mechanism 40 which supplies the sheet P to the drum 21.

The drum 21 is further detailed with reference to FIG. 2. Note that the curved surface 51*s* of a later-mentioned blocking piece 51 is drawn with dotted-lines in FIG. 2. The drum 21 has a pipe-like shape and the axial direction thereof conforms with a direction perpendicular to the surface of the FIG. 1. The both ends of the drum 21 is closed. The centers of the both closed ends of the drum 21 are connected with each other via a tubular shaft 27 extending in the axial direction and penetrating the both ends. The tubular shaft 27 rotates with the drum 21.

The outer circumferential surface 21*a* is formed on a circumferential wall of the drum 21. This circumferential wall has through holes 22 communicating an internal space 23 of the drum 21 with the outside of the drum. These through holes 22 are all uniformly formed only in a sheet placing area (recording medium placing area). The sheet placing area is an area of the outer circumferential surface 21*a* of the drum 21, in which area a sheet P is placed. In the present embodiment, the sheet placing area is an area of a 180 degree angular range about the rotation axis of the drum 21. In other words, the sheet placing area is an area of the outer circumferential surface 21*a* having a length equivalent to a length from the supply position S1 to the separating position S2 in the conveyance direction A. In relation to the length in the conveyance direction A, the sheet placing area is equal to or longer than a sheet P having a maximum length conveyable on the drum 21.

Further, the circumferential wall of the tubular shaft 27 has through holes 27*a* communicating the inside of the tubular shaft 27 with the internal space 23. The left end of the tubular shaft 27 is sealed, and the right end of the same is connected to an air-suction device 28 having a fan 28*a*. Driving the air-suction device 28 sucks the air in the internal space 23 into the tubular shaft 27 via the through holes 27*a*, and from the tubular shaft 27 to the outside the drum 21. This creates an air flow from the outside of the drum 21 to the internal space 23 via the suction holes 22, creating a pressure difference between the suction holes 22 and the outside of the drum 21 over the sheet P, thereby adsorbing the sheet P on the outer circumferential surface 21*a* of the drum 21.

On the left end of the tubular shaft 27 is supported a pulley 24 which rotates along with the tubular shaft 27. Further, a belt 26 is looped around the pulley 24 and a pulley 29 attached to the rotational shaft of a conveyance motor 25. The conveyance motor 25 rotates the belt 26, the pulleys 24 and 29, the tubular shaft 27, and the drum 21 counterclockwise in FIG. 1, thereby conveying a sheet adsorbed and retained on the outer circumferential surface 21*a* in a conveyance direction A, along the outer circumferential surface 21*a* of the drum 21.

On the outside of one end of the drum 21 is supported a disc 61 so that the disc 61 is rotatable with the tubular shaft 27. The disc 61 is fixed to the tubular shaft 27, and rotates in sync with the drum 21 at the same angular speed as the drum 21. The disc 61 is provided with a single slit 61*a* formed at the edge of the disc 61 in the radial direction. Further, a transmissive photosensor 62 is provided so as to face the edge of the disc 61. This photosensor 62 serves as detecting unit for detecting light passed through the slit 61*a*. From a detection result given by the photosensor 62, the control device 10 derives the angular orientation of the drum 21. Then, the pickup roller 31 is driven so that the leading end of the sheet P having lead through the introduction path 41 coincides with the leading end of the sheet placing area when the sheet P is placed on the outer circumferential surface 21*a*. The sheet P therefore is placed on the sheet placing area without fail.

In the present embodiment, the conveyance motor 25, belt 26, tubular shaft 27, pulleys 24 and 29, or the like form a drum drive device. This drum drive device, drum 21, and the air-suction device 28 form the sheet conveyance mechanism 20. Driving the air-suction device 28 adsorbs and retains on the outer circumferential surface 21*a* a sheet P at the supply position S having conveyed through the introduction path 41 from the sheet-feeding tray 11. Then, as the drum drive device drives the drum 21 to rotate the same in the counter clockwise direction, the sheet P is conveyed in the conveyance direction A. Then, the inkjet heads 2 eject ink of different colors to the sheet P conveyed on the drum 21, while the respective ejection surfaces 2*a* of the inkjet heads 2 face the sheet P. Thus, an intended colored image is printed on the sheet P.

In the internal space 23 of the drum 21 is positioned a blocking piece 51 serving as a blocker. The blocking piece 51 is formed substantially in a U-shape, and includes an outer circumferential plate and two support plates 51*b*. On the outside of the outer circumferential plate is formed a curved surface 51*a*. The curved surface 51*a* is a part of the blocking piece 51 which is farthest from the tubular shaft 27, and is curved along the inner circumferential surface of the drum 21 defining the internal space 23. The two support plates 51*b* on the other hand are parts whereby both ends of the outer circumferential plate in the axial direction are supported. These support plates 51*b* are fixed to the tubular shaft 27 and has a length which substantially equals the internal radius of the drum 21. The width of the curved surface 51*a* in the circumferential direction of the drum 21 is substantially the same as the ejection surface 2*a* of an inkjet head 2.

The curved surface 51*a* faces a range of the inner surface of the drum 21 and is closely disposed to the range. More specifically, the range of the inner surface of the drum 21 is a part of the inner surface from the separating position S2 to a position which is displaced in the rotation direction of the drum 21 by a distance substantially equal to the width of the ejection surface 2*a*. Further, the curved surface 51*a* is slightly shorter than the drum 21 in the axial direction, and is positioned so as to cover a range of the drum 21 in the axial direction, in which range the through holes 22 are formed.

Figure 2:
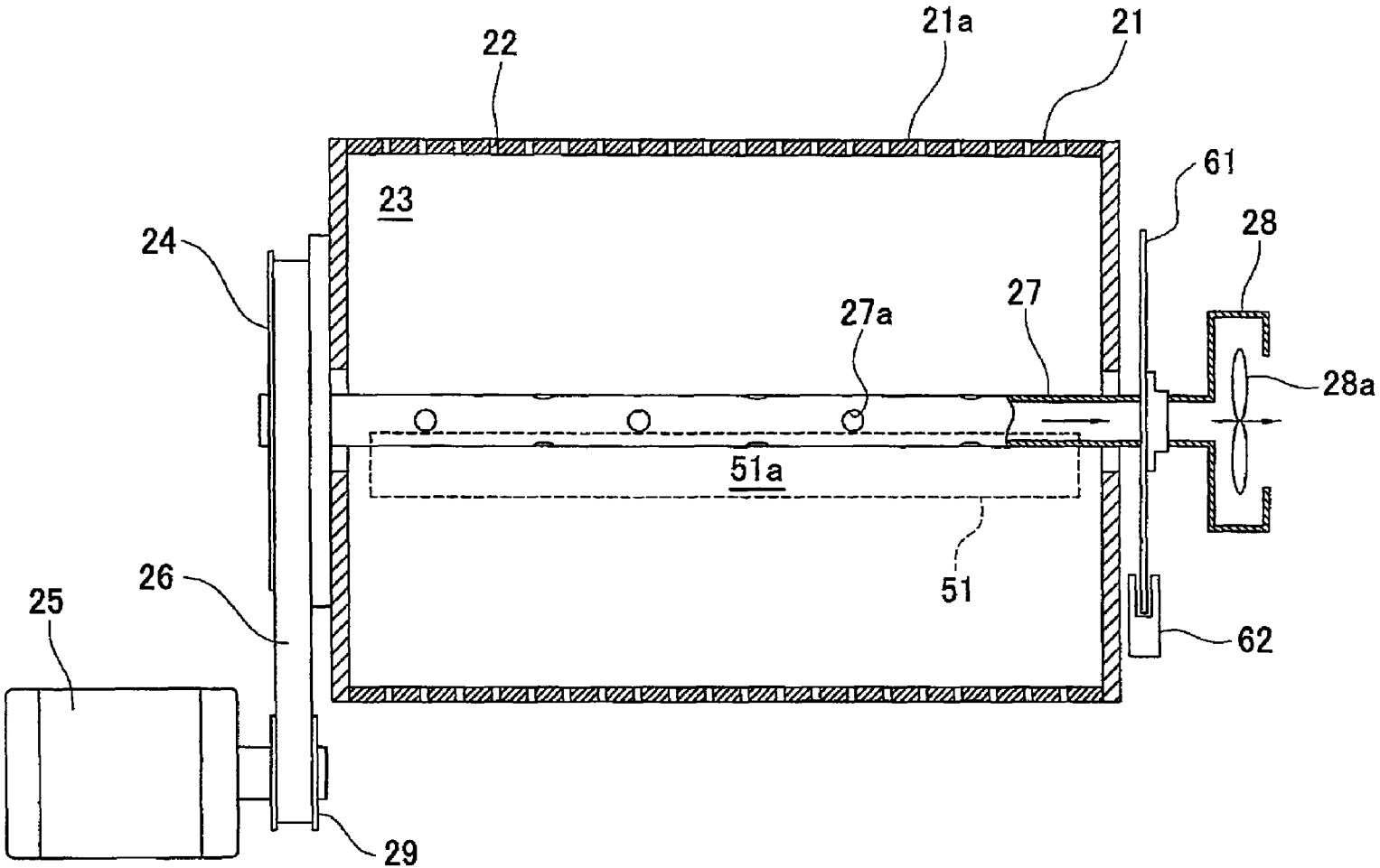
FIG. 2 is a cross sectional view illustrating the inkjet printer of FIG. 1, taken along the line II-II.
Figure 3:
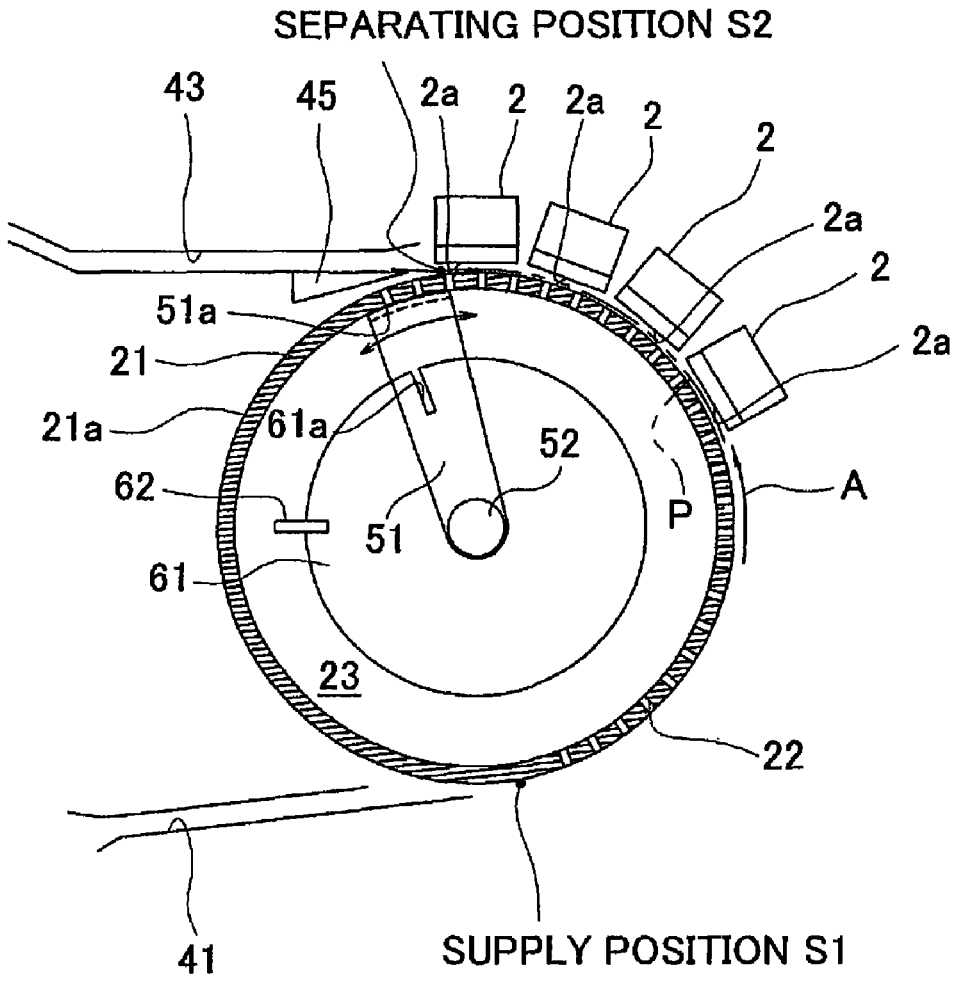
FIG. 3 is a side view of a part of the inkjet printer illustrating an operation of a blocker illustrated in FIG. 1.

As shown in FIG. 2 and FIG. 3, the blocking piece 51 is supported by the tubular shaft 27 so that the blocking piece 27, under the control of the control device 10, is able to move in the circumferential direction within such a range that the curved surface 51 faces the separating position D. The position of the curved surface 51*a* therefore is adjustable by swinging the blocking piece 51 within a predetermined angular range, which is a relatively small range, so that the range of the internal surface of the drum 21 covered by the curved surface 51*a* is variable. Note that the blocking piece 51 swings independently of the rotation of the drum 21.

The curved surface 51*a* of the blocking piece 51 successively faces at least one of the suction holes 22 whose outer openings are blocked by a sheet P, and which have reached the separating position S2 with the rotation of the drum 21. At this time, the curved surface 51*a* is barely spaced from the internal surface of the drum 21 having the inner openings of the suction holes 22. Therefore, the inner opening of the at least one of the suction holes 22 is blocked by the curved surface 51. Blocking, by the curved surface 51*a*, the inner opening of at least one of the suction holes 22 having reached the separating position S2 reduces the pressure difference between the at least one of the suction holes 22 and the outside of the drum 21 over the sheet P, thereby reducing the adsorbing force of the at least one of the suction holes 22. Thus, the sheet P having reached the separating position S2 becomes easily separable from the outer circumferential surface 21*a* of the drum 21, successively from the leading end of the sheet P. Further, the blocking piece 51 is in the internal space 23 of the drum 21 and the curved surface 51*a* of the blocking piece 51 faces the inner circumferential surface of the drum 21 to block the inner opening of the suction hole 22. The suction force for the sheet P in the suction hole 22 therefore drops immediately after the curved surface 51*a* faces the inner opening of the suction hole 22. Thus, the sheet P becomes easily separable from the outer circumferential surface 21*a* successively from the leading end to the trailing end, immediately after the leading of the sheet P reaches the separating position D. Further, the above structure only requires that the blocking piece 51 be disposed in the internal space 23 of the drum 21, and there is no need of moving the blocking piece 51. Thus, the structure is made simple.

In the present embodiment, the control device 10 controls, according to various conditions including rotation speed of the drum 21 or the like, the position of the curved surface 51*a* in the circumferential direction of the drum 21 so as to adjust the position relative to the circumferential direction in which position the sheet P becomes easily separable from the outer circumferential surface 21*a*. The present embodiment therefore ensures that the sheet P separated from the outer circumferential surface 21*a* of the drum 21 is fed toward the ejection path 43. Note that the position of the curved surface 51*a* may be manually adjustable.

Immediately downstream from the separating position S2 along the sheet conveyance path is provided a separator 45. The separator 45 separates, from the outer circumferential surface 21*a*, the sheet P whose leading end has reached the separating position S2 and become easily separable from the outer circumferential surface 21*a*, and feeds the sheet toward the ejection path 43. In the present embodiment, the separator 45 and the ejection path 43 form an ejection mechanism which ejects a sheet P from the drum 21.

The inkjet printer 1 is provided with a not-illustrated head-moving mechanism which moves the inkjet heads 2 in a direction departing from the outer circumferential surface 21*a* of the drum 21; and a not-illustrated maintenance unit which performs a maintenance operation with respect to the inkjet heads 2. The maintenance operation of the inkjet heads 2 includes: a process of discharging thickened ink inside the nozzle openings on the ejection surfaces 2*a*, and a process of shaping a meniscus of ink formed on each of the nozzle openings. The maintenance operation is performed at a time of powering on the inkjet printer 1, or immediately before performing a printing operation to a sheet P.

Specifically, the maintenance unit includes: caps each of which forms a sealed space having an ejection surface 2*a* as an inner-wall surface; a wiper serving as a blade for wiping the ejection surface 2*a;* and a maintenance move mechanism which moves the caps and a wiper. When performing the maintenance operation, the head-moving mechanism moves the four inkjet heads 2 in a direction departing from the outer circumferential surface 21*a* of the drum 21, and the maintenance move mechanism moves the caps so that the caps respectively face the ejection surfaces 2. After the head-moving mechanism moves the four inkjet heads 2 so that each of the caps forms a sealed space having the corresponding ejection surface 2*a* as the inner-wall surface, a purging operation for discharging ink inside nozzles is performed. That way the ink droplets ejected from the ejection surface 2*a* is received in the cap. Then, the head-moving mechanism 2 lifts the inkjet heads 2 to such a height that the leading end of the wiper contacts the ejection surfaces 2*a*, after which the maintenance move mechanism moves the wiper to wipe the ejection surface 2*a*. Thus, the ejection surface 2*a* is wiped, and a meniscus to be formed at each of the nozzle openings is shaped. Then, the head-moving mechanism moves the inkjet heads 2 to an ordinary printing position, thus completing the maintenance operation.

Next, the following describes with reference to FIG. 1 to FIG. 3 an operation of the printer 1 at a time of performing printing to the sheet P. When performing the printing to a sheet P, the supply mechanism 40 first supplies a sheet P from the sheet-feeding tray 11 to the outer circumferential surface 21*a* of the drum 21. In this step, the uppermost sheet P among a stack of sheets P stored in the sheet-feeding tray 11 contacts the pickup roller 31, as illustrated in FIG. 1. Then, the pickup roller 31 rotates counter clockwise while being in contact with the sheet P, thereby feeding the sheet P to the introduction path 41. The sheet P having fed is lead through the introduction path 41 so as to be placed on the outer circumferential surface 21*a* of the drum 21 at the supply positions. At this point, the leading end of the sheet placing area and the leading end of the sheet P lead through the introduction path 41 are coincided with each other, as hereinabove mentioned.

At the same time, the conveyance motor 25 rotates the drum 21 in the conveyance direction A, and the air-suction device 28 is driven to adsorb and retain the sheet P on the outer circumferential surface 21*a* of the drum 21. The sheet P retained on the outer circumferential surface 21*a* of the drum 21 is then conveyed in the conveyance direction A with the rotation of the drum 21.

When the sheet P reaches a position so as to face the ejection surface 2*a*, the ejection surfaces 2*a* of the four inkjet heads 2 eject ink from their nozzles to form an image on the sheet P. Then, after the leading end of the sheet P with the image formed reaches the separating position D, the inner opening of at least one of the suction holes 22 which are in the sheet placing area and whose outer openings are blocked by the sheet P successively faces the curved surface 51*a* of the blocking piece 51, thus blocking the inner opening of the at least one of the suction holes 22. As a result, the pressure difference between the at least one of the suction holes 22 and the outside of the drum 21 over the sheet P is reduced. Consequently, the suction force in the at least one of the suction holes 22 is reduced. This promptly makes the sheet P easily separable from the outer circumferential surface 21*a,* successively from its leading end towards the trailing end. Then, the easily separable sheet P is separated by the separator 45 from the outer circumferential surface 21*a* of the drum 21 at downstream from the separating position D. The separated sheet P is then conveyed to the ejection path 43. The sheet P fed to the ejection path 43 is conveyed towards the sheet receiving tray 12, and is received by the sheet receiving tray 12. Thus, the printing operation to the sheet P is completed.

With the embodiment, the curved surface 51 of the blocking piece 51 positioned in the internal space 23 of the drum 21 successively faces the inner opening of at least one of the suction holes 22 having reached the separating position D, thereby blocking the inner opening of the at least one of the suction holes 22. Directly blocking, by the blocking piece 51, the inner opening of each of the at least one of the suction holes 22 as described above reduces the pressure difference between each of the at least one of the suction holes 22 and the outside of the drum 21 over the sheet P. Thus, the suction force in each of the at least one of the suction holes 22 drops immediately after the inner opening thereof faces the blocking piece 51. The sheet P therefore successively becomes easily separable from the outer circumferential surface 21*a,* successively from its leading end to the trailing end, immediately after the leading end of the sheet P reaches the separating position D. Further, the above structure is advantageous in that the blocking piece 51 only needs to be inside the drum 21, and there is no need of moving the blocking piece 51. Thus, the structure is made simple.

Further, the sheet P is placed on the outer circumferential surface 21*a* of the drum 21, and is conveyed with the rotation of the drum 21. Unlike a structure which adopts a belt looped around rotational shafts and which conveys a sheet P placed on the belt with the rotation of the belt, the present embodiment does not require such a belt, and therefore is more advantageous in terms of durability of the sheet conveyance mechanism.

Further, the blocking piece 51 has a curved surface 51*a* curved along the inner circumferential surface of the drum 21. This curved surface 21 blocks the inner opening of at least one of the suction holes 22. It is therefore possible to effectively block the inner opening of at least one of the suction holes 22 successively reaching the separating position S2 with the rotation of the drum 21.

Additionally, the blocking piece 51 whose position is variable by the control device 10 allows modification of the range of the inner surface of the drum 21 covered by the curved surface 51*a*. Accordingly, it is possible to adjust in the circumferential direction the position in which the sheet P becomes easily separable from the outer circumferential surface 21*a* to feed the sheet P towards the ejection path 43 without fail.

Further, the suction holes 22 are formed only in the sheet placing area which substantially ranges 180 degrees about the rotation axis of the drum 21, and the control device 10 drives the pickup roller 31 based on a detection result given from the photosensor 62 so as to place the sheet P on the sheet placing area. Thus, the sheet P is placed on the sheet placing area without fail. Further, since the suction holes 22 are formed only in the sheet placing area, the suction force per suction hole 22 is higher than a structure in which suction holes are formed on the overall circumferential wall of the drum 21. Note that the angular range of the sheet placing area is not limited as long as the angle range is less than 360 degrees.

In relation to the length in the conveyance direction A, the sheet placing area is equal to or longer than a sheet P having a maximum length conveyable on the drum 21. Therefore, a sheet P of any conveyable sizes is entirely adsorbed on the drum 21 without fail.

Embodiment 2

Next, Embodiment 2 of the present invention is described with reference to FIG. 4 to FIG. 6. Note that the structure of the present embodiment is essentially the same as that of the foregoing Embodiment 1 except for the sheet conveyance mechanism. The following therefore mainly describes the sheet conveyance mechanism and explanation for the rest of the members are omitted here.

Figure 4:
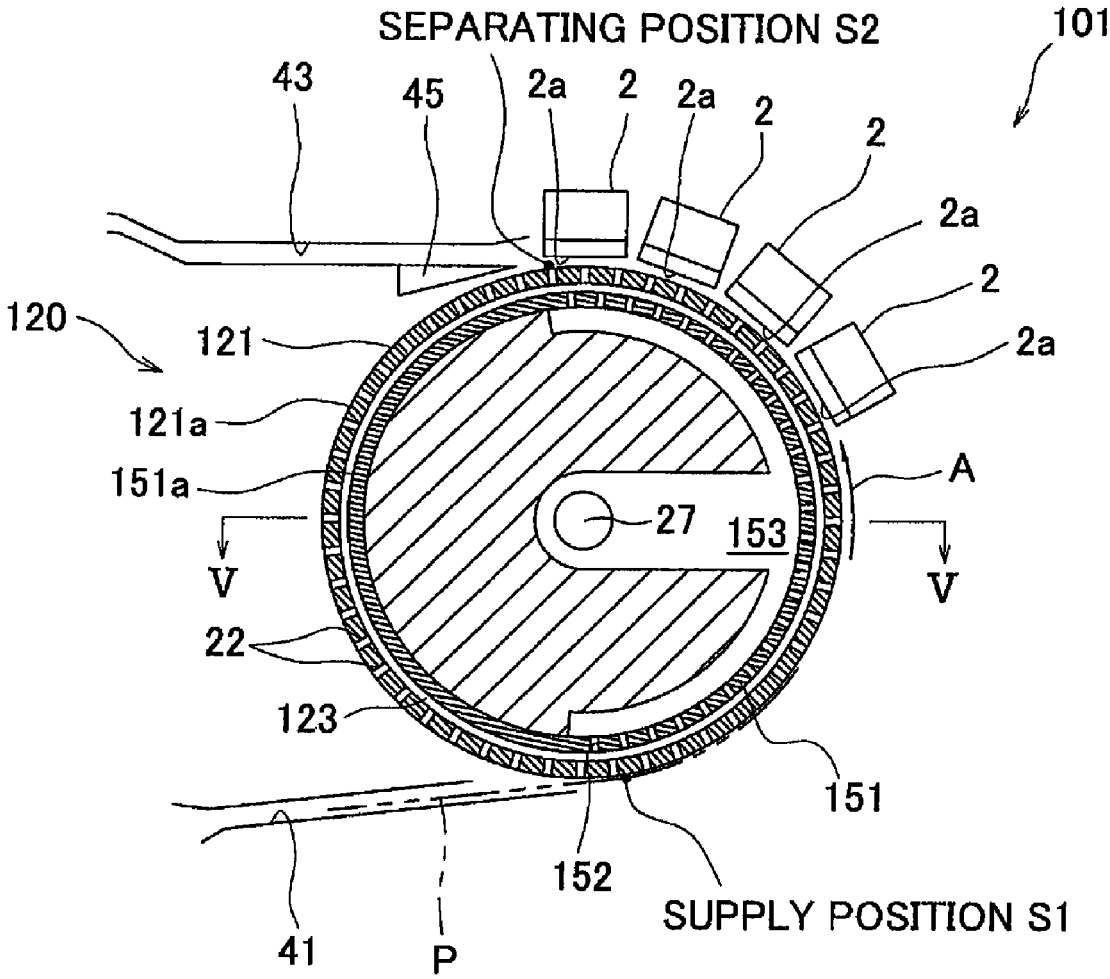
FIG. 4 is a side view illustrating a part of an inkjet printer of Embodiment 2, according to the present invention.
Figure 5:
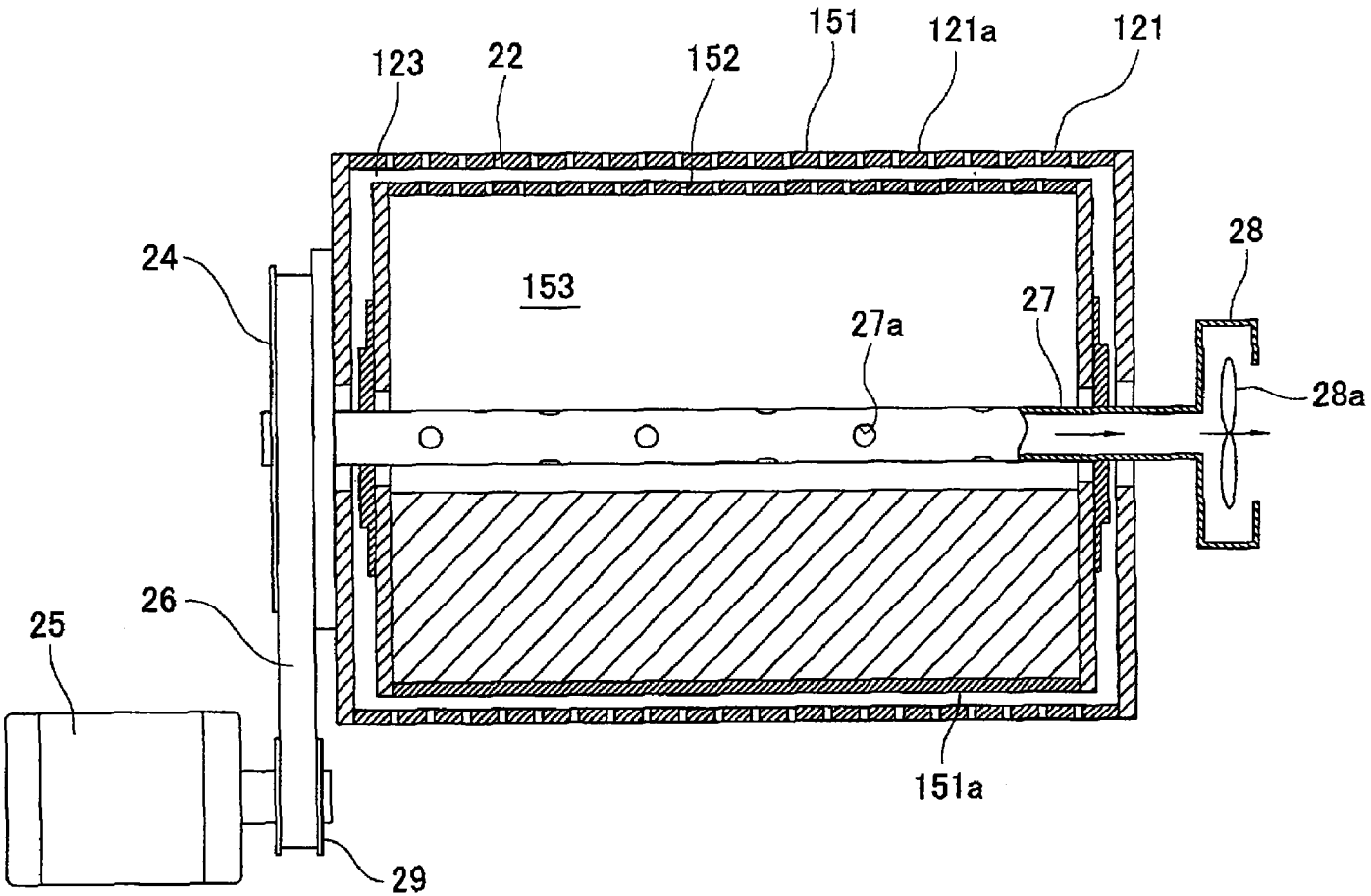
FIG. 5 is a cross section view illustrating an inkjet printer of FIG. 4, taken along the line V-V.

As shown in FIG. 4 and FIG. 5, the sheet conveyance mechanism of an inkjet printer 101 of the present embodiment serving as an image recording apparatus includes: a drum 121 having a cylindrical outer circumferential surface 121. The supply position S1 and the separating position S2 are the same as those in the printer 101 of Embodiment 1. The drum 121 has a pipe-like shape and the axial direction thereof conforms with a direction perpendicular to the surface of the FIG. 4. The both ends of the drum 121 is closed. The centers of the both closed ends of the drum 21 are connected with each other via a tubular shaft 27 extending in the axial direction and penetrating the both ends. The tubular shaft 27 rotates with the drum 121. This circumferential wall has through holes 22 communicating an internal space 123 of the drum 121 with the outside of the drum. These through holes 22 are all uniformly formed throughout the entire circumferential wall.

In the internal space 123 of the drum 121 is positioned another drum (blocking drum) 151 which is an inner drum serving as a blocker. This blocking drum 151 has a pipe-like shape and shares the same rotation axis with the drum 121. The outer circumferential surface of the blocking drum 151 faces the inner circumferential surface of the drum 121 which is the outer drum, and is close to the inner circumferential surface of the drum 121. The blocking drum 151 is supported by the tubular shaft 27 in such a manner that the blocking drum 151 is able to rotate by a predetermined angular range which is a relatively small range. The blocking drum 151 rotate independently of the rotation of the drum 121.

Inside the blocking drum 151 is formed a hollow space 153. The hollow space 153 has a semi-cylindrical area and a connecting area. The semi-cylindrical area has substantially the same thickness as that of the circumferential wall of the drum 151 in the radial direction, and extends from slightly upstream of the supply position S1 to the separating position S2 in the conveyance direction A. The connecting area connects the semi-cylindrical area with the tubular shaft 27. Further, the on the circumferential wall of the blocking drum 151 are formed communicating holes 152 each communicating the hollow space 153 with the outside via the suction holes 22. The communicating holes 152 are uniformly formed only in a suction area of the blocking drum 151. The suction area is an area from the supply position S1 to the separating position S2 in the conveyance direction A. In the present embodiment, the suction area is an area covering an angle range of substantially 180 degrees about the rotation axis of the drum 21.

On the other hand, the circumferential wall of the blocking drum 151 has an area where no communicating hole 152 is formed. This, in other words, is a blocking area ranging from the separating position S2 to the supply position S1 in the conveyance direction A. This blocking area has a curved surface 151*a* curved along the inner circumferential surface of the drum 121 defining the internal space 123. The curved surface 151*a* is positioned closely to a part of the inner circumferential surface of the drum 121 ranging from the separating position S2 to the supply position S1 in the rotation direction, and faces the part of the inner circumferential surface of the drum 121. Further, the curved surface 151*a* faces the inner openings and blocks the inner openings of all the suction holes 22 within the range from the separating position S2 to the supply position S1 in the rotation direction of the drum 121.

The curved surface 151*a* may be close to and face a range of the inner circumferential surface of the drum 121 from the separating position S2 to a position not reaching the supply position S1 in the rotation direction. In other words, the range of the blocking area and the curved surface 151 is not particularly limited, provided that the blocked area ranges from the separating position S2 to a position which is a certain distance away from the separating position S2 in the rotation direction of the drum 121 so that the suction force is sufficiently reduced to make a sheet P easily separable. Further, the range of the suction area may be modified as needed according to modification of the range of the curved surface 151*a*.

Further, the circumferential wall of the tubular shaft 27 has through holes 27*a* communicating the inside of the tubular shaft 27 with the hollow space 153. The left end of the tubular shaft 27 is sealed, and the right end of the same is connected to an air-suction device 28 having a fan 28*a*. Driving of the air-suction device 28 sucks the air in the hollow space 153 (the air in the internal space 123) into the tubular shaft 27 via the communicating holes 27*a* and from the tubular shaft 27 to the outside the drum 21. This creates an air flow from the outside to the hollow space 153, passing the suction holes 22 and the communicating holes 152 nearby the suction holes 22. This creates a pressure difference between the suction holes 22 and the outside of the drum 121 over the sheet P to adsorb the sheet P on the outer circumferential surface 121*a* of the drum 121. In the present embodiment, the hollow space 153 is only a part of the blocking drum 151, and therefore the hollow space 153 has a relatively small volume. Accordingly, suction force per suction hole 22 is increased.

The curved surface 151*a* of the blocking drum 151 successively faces at least one of suction holes 22 which have reached the separating position S2 with the rotation of the drum 121, and whose outer openings are blocked by the sheet P. At this time, the curved surface 151*a* is barely spaced from a part of the inner circumferential surface of the drum 121 including the inner openings of the suction holes 22. The at least one of the suction holes 22 therefore is blocked by the curved surface 151*a*. Blocking, by the curved surface 151*a*, the inner opening of at least one of the suction holes 22 having reached the separating position S2 reduces the pressure difference between the suction holes 22 and the outside of the drum 21 over the sheet P, thereby reducing the adsorbing force of the suction hole 22. Thus, the sheet P having reached the separating position S2 becomes easily separable from the outer circumferential surface 121*a* of the drum 121, successively from its leading end. Further, the blocking drum 151 positioned in the internal space 123 of the drum 121 has the curved surface which faces the inner circumferential surface of the drum 121 to block the inner opening of the suction hole 22. Therefore the suction force in the suction hole 22 for the sheet P drops as soon as the inner opening of the suction hole faces the curved surface 151*a*. Accordingly, the sheet P becomes easily separable from the outer circumferential surface 21*a*, successively from its leading end to the trailing end, immediately after the leading end of the sheet P reaches the separating position D. Further, the above structure only requires that the blocking drum 151 be disposed in the internal space 123 of the drum 121, and there is no need of moving the blocking drum 151. Thus, the structure is made simple.

Note that, during the rotation of the drum 121, the inner opening of the suction hole 22 is blocked by a portion of the suction area other than the outer openings of the communicating holes 152 while the communicating holes 152 and the suction hole 22 are not in communication with each other. However, the period of the inner opening of the suction hole 22 being blocked is very short, because more than one communicating holes 152 are uniformly formed in the suction area. Further, the suction hole 22 communicates with different one of different communicating holes 152, one after another. Accordingly, the suction force for the sheet P in the suction holes 22 within the range from the supply position S1 to the separating position S2 in the rotation direction is substantially constant, although the suction force slightly drops while the inner opening of the suction hole 22 is blocked.

In the present embodiment, the control device 10 controls, according to various conditions including rotation speed of the drum 121 or the like, the position of the curved surface 151*a* in the circumferential direction of the drum 121 so as to adjust the position relative to the circumferential direction in which position the sheet P becomes easily separable from the outer circumferential surface 121*a*. The present embodiment therefore ensures that the sheet P separated from the outer circumferential surface 121*a* of the drum 121 to feed toward the ejection path 43. Note that the position of the curved surface 151*a* may be manually adjustable.

In the present embodiment, the conveyance motor 25, belt 26, tubular shaft 27, pulleys 24 and 29, or the like form a drum drive device. This drum drive device, drum 121, and the air-suction device 28 form the sheet conveyance mechanism 120. Driving the air-suction device 28 adsorbs and retains on the outer circumferential surface 121*a* a sheet P at the supply position S having conveyed through the introduction path 41 from the sheet-feeding tray 11. Then, as the drum drive device drives the drum 121 to rotate the same in the counter clockwise direction, the sheet P is conveyed in the conveyance direction A. Then, the inkjet heads 2 eject ink of different colors to the sheet P conveyed on the drum 121, while the respective ejection surfaces 2*a* of the inkjet heads 2 face the sheet P. Thus, an intended colored image is printed on the sheet P.

Figure 6:
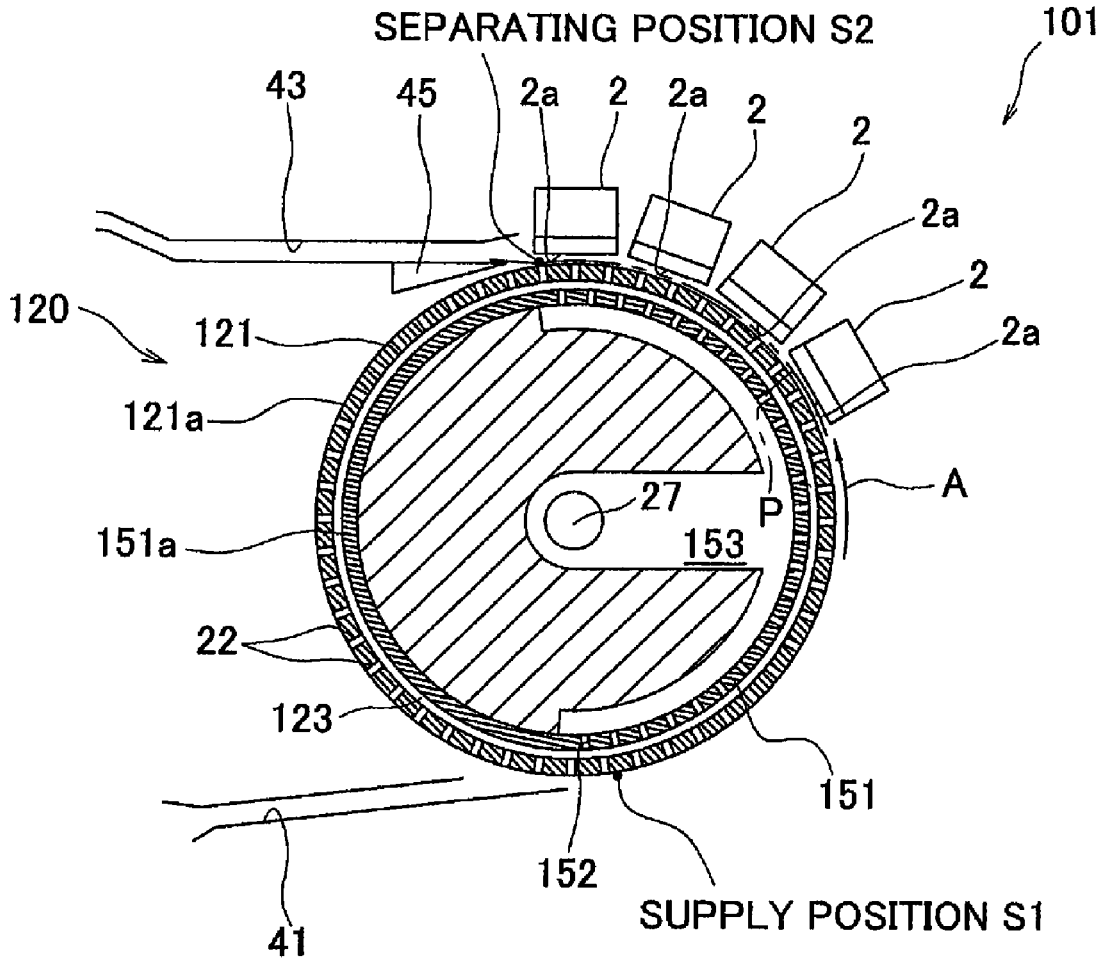
FIG. 6 is a side view of a part of the inkjet printer, illustrating an operation of a sheet conveyance mechanism illustrated in FIG. 4.

Next, the following describes, with reference to FIG. 6, an operation of the printer 101 at a time of performing printing to the sheet P. First, at the supply position S, the sheet P fed from the sheet-feeding tray 11 through the introduction path 41 is successively adsorbed and retained, from its leading end to the trailing end, on the outer circumferential surface 121*a* of the drum 121 as illustrated in FIG. 4. Then, with the rotation of the drum 121, the sheet P is conveyed in the conveyance direction A. Note that the blocking drum 151 is fixed on the tubular shaft 27, and does not rotate along with the drum 121.

When the sheet P reaches a position so as to face the ejection surface 2*a*, the ejection surfaces 2*a* of the four inkjet heads 2 eject ink from their nozzles to form an image on the sheet P. Then, after the leading end of the sheet P with the image formed reaches the separating position D, the inner opening of at least one of the suction holes 22 whose outer openings are blocked by the sheet P successively faces the curved surface 151*a* of the blocking drum 151, thus blocking the inner opening of the at least one of the suction holes 22. As a result, the pressure difference between the suction hole 22 and the outside of the drum 21 over the sheet P is reduced, consequently reducing the suction force in the suction holes 22. Thus, the sheet P promptly becomes easily separable from the outer circumferential surface 21*a*, successively from its leading end towards the trailing end. Then, the easily separable sheet P is separated by the separator 45 from the outer circumferential surface 21*a* of the drum 21 at downstream from the separating position D. The separated sheet P is then conveyed to the ejection path 43. The sheet P fed to the ejection path 43 is conveyed towards the sheet receiving tray 12, and is received by the sheet receiving tray 12. Thus, the printing operation to the sheet P is completed.

With the embodiment, the curved surface 151 of the blocking drum 151 positioned in the internal space 123 of the drum 121 successively faces the inner opening of at least one of suction holes 22 reached the separating position D, thereby blocking the inner opening of the at least one of the suction holes 22. Directly blocking, by the curved surface 151*a* of the blocking drum 151, the inner opening of each of the suction holes 22 as described above reduces the suction force in the suction hole 22, immediately after the inner opening thereof faces the blocking drum 151. Accordingly, the sheet P becomes easily separable from the outer circumferential surface 121*a*, successively from its leading end to the trailing end, successively, immediately after the leading end of the sheet P reaches the separating position D. Further, the above structure is advantageous in that the blocking drum 151 only needs to be inside the drum 121, and there is no need of moving the blocking drum 151. Thus, the structure is made simple.

Further, the blocking drum 151 has a curved surface 151*a* curved along the inner circumferential surface of the drum 121. This curved surface 151*a* directly blocks the inner opening of at least one of the suction holes 22. It is therefore possible to effectively block the inner opening of at least one of the suction holes 22 successively reaching the separating position S2 with the rotation of the drum 121.

Further, the communicating holes 152 formed in the suction area of the blocking drum 151 communicates the hollow space 153 with the outside. Therefore, a desirable suction force in each of the suction holes is achieved by suitably adjusting the number and/or the shape of the communicating holes 152.

Additionally, the suction holes 22 for communicating the outside with the hollow space 153 are uniformly formed throughout the entire circumferential wall of the drum 121. It is therefore possible to adsorb the sheet P in any give position of the outer circumferential surface 121*a*. Accordingly, the sheet P is supplied to the outer circumferential surface 121*a* without a need of detecting the angular orientation of the drum 121.

Further, the curved surface 151*a* faces the inner openings of all the suction holes 22 within a range from the separating position S2 to the supply position S1 in the rotation direction of the drum 121, thereby blocking the inner openings of these suction holes 22. The suction force per suction hole 22 therefore is increased for each of the suction holes 22 which are within the range from the supply position S1 to the separating position S2 in the conveyance direction A, and whose outer opening is blocked by the sheet P.

Both of the above described Embodiments 1 and 2 deal with a case where the sheet P is conveyed on the drum 21 or 121. It is however possible to adopt a structure in which a sheet P is conveyed on a conveying belt which is looped around more than one rollers and whose conveyance surface has more than one suction holes.

Further, both of the above described Embodiments 1 and 2 are an exemplary application of the present invention to an inkjet printer having a line-type inkjet heads each having nozzles for ejecting ink. However, the application of the present invention is not limited to such an inkjet printer. For example, the present invention is applicable to a printer having a different type of record head such as a serial type inkjet head or thermal type inkjet head.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus, comprising:

a conveyance mechanism having a circumferential wall having thereon a plurality of suction holes for communicating an internal space inside the circumferential wall with the outside of the circumferential wall, the conveyance mechanism being structured to convey, with rotation of the circumferential wall, a recording medium placed on an outer circumferential surface of the circumferential wall;

a suction unit which sucks the air in the internal space to create an air flow from the outside of the circumferential wall to the internal space via the suction holes;

a supply mechanism which supplies, at a supply position, a recording medium to the outer circumferential surface;

a record head disposed to face the outer circumferential surface, which records an image on the recording medium conveyed on the outer circumferential surface by the conveyance mechanism;

an ejection path branched off from the outer circumferential surface at a separating position which is a position at a most downstream position of the record head or a position further from the supply position than the most downstream position from the supply position, the ejection path being structured to pass therethrough an image-recorded recording medium to be ejected on the outer circumferential surface; and a blocker disposed in the internal space, which successively faces and blocks an inner opening of at least one of the suction holes having reached the separating position with the rotation of the circumferential wall.

2. The apparatus according to claim 1, wherein: the conveyance mechanism includes a drum having the outer circumferential surface having a cylindrical shape, the drum being structured to convey the recording medium by retaining the recording medium on the outer circumferential surface thereof, while rotating about a rotation axis thereof.

3. The apparatus according to claim 2, wherein: the blocker has a curved surface which blocks the inner opening of the at least one of the suction holes, the curved surface (i) being curved along an inner circumferential surface of the drum which defines the internal space, and (ii) facing a part of the inner circumferential surface, which ranges from the separating position, inclusive, to a position between the separating position and the supply position and distant from the separating position in the rotation direction of the drum.

4. The apparatus according to claim 3, wherein:

the blocker shares the same axis with the drum, and has (i) a hollow space provided inside the blocker and (ii) a cylindrical outer circumferential surface;

the blocker further includes a plurality of communicating holes which are formed in a range from a position facing the supply position to a position facing the separating position in the rotation direction of the drum and which communicate the hollow space with the outside of the drum via the suction holes; and the suction unit sucks the air inside the hollow space.

5. The apparatus according to claim 3, wherein the blocker is fixed to enable adjustment of a position of the curved surface, so that a part, of the inner circumferential surface of the drum, facing the curved surface is variable.

6. The apparatus according to claim 2, wherein the suction holes of the drum are formed only in a recording medium placing area which extends a predetermined angle range about the rotation axis of the drum; and the apparatus further includes:

a detecting unit which obtains an angular orientation of the drum; and a control unit which controls, based on a detection result given by the detection unit, supplying of the recording medium so that the recording medium is placed in the recording medium placing area.

7. The apparatus according to claim 6, wherein:

in relation to the length in the direction of conveyance by the conveyance mechanism, the recording medium placing area is equal to or longer than a recording medium having a maximum length conveyable on the drum.

8. The apparatus according to claim 2, wherein the suction holes are distributed throughout the entire drum.

9. The apparatus according to claim 8, wherein the blocker faces and blocks the inner openings of all the suction holes within a range from the separating position to the supply position in the rotation direction of the drum.

* * * * *